United States Patent [19]

Jouguelet

[11] Patent Number: 4,884,622

[45] Date of Patent: Dec. 5, 1989

[54] MOULD FOR MOULDING OF A FOUNDRY PATTERN AND PROCESS FOR PUTTING IT INTO PRACTICE

[75] Inventor: Denis Jouguelet, Raynans, France

[73] Assignees: Automobiles Peugeot, Paris; Automobiles Citroen, Neuilly, both of France

[21] Appl. No.: 241,949

[22] Filed: Sep. 8, 1988

[30] Foreign Application Priority Data

Sep. 11, 1987 [FR] France ..... 87 12642

[51] Int. Cl.[4] ..... B22C 7/02

[52] U.S. Cl. ..... 164/45; 164/246; 164/342; 249/83; 249/145; 249/160

[58] Field of Search ..... 164/45, 245, 246, 341, 164/342, 343; 249/83, 93, 145, 160

[56] References Cited

U.S. PATENT DOCUMENTS

| | | | |
|---|---|---|---|
| 2,824,347 | 2/1958 | Winship et al. | 164/344 |
| 2,965,938 | 12/1960 | Davis | 164/340 |
| 3,897,816 | 8/1975 | Nishiyama et al. | 164/230 |
| 4,533,312 | 8/1985 | Von Holdt | 425/438 |
| 4,576,568 | 3/1986 | Grannen | 425/577 |
| 4,632,169 | 12/1986 | Osborn et al. | 164/45 |

FOREIGN PATENT DOCUMENTS

| | | | |
|---|---|---|---|
| 70763 | 1/1983 | European Pat. Off. | 425/577 |
| 1113726 | of 1961 | Fed. Rep. of Germany . | |
| 2479044 | of 1980 | France . | |
| 54-133554 | 10/1979 | Japan . | |
| 935209 | 6/1982 | U.S.S.R. . | |

*Primary Examiner*—Richard K. Seidel

*Attorney, Agent, or Firm*—Burns, Doane, Swecker & Mathis

[57] ABSTRACT

A three part mould for an engine cylinder block which has several aligned cylinders with parallel axes, several bearings for mounting a crankshaft having an axis perpendicular to the cylinder axes, voids formed around the cylinders, and recesses between the bearings and the cylinders, includes an upper segment, a lower segment and a central segment. The three segments are superposed in the direction of the cylinder axes. The upper segment forms the cylinders and at least one portion of the voids. The lower segment forms the bearings and at least one part of the recesses. The central segment forms matching parts of the voids and the recesses.

6 Claims, 4 Drawing Sheets

MOULD FOR MOULDING OF A FOUNDRY PATTERN AND PROCESS FOR PUTTING IT INTO PRACTICE

The subject of the present invention is a mould for the moulding of a foundry pattern of an engine cylinder block comprising several aligned cylinders of parallel axes, several bearings for the mounting of a crankshaft, the axis of which is perpendicular to the axis of the cylinders, voids formed round the cylinders and recesses between the bearings and the cylinders.

The object of the invention is, more particularly to make it possible to produce a pattern from expanded polystyrene, used in the technique of moulding from patterns composed of waste foam, known as the lost-foam technique or the lost-foam moulding process.

In this technique, a pattern consisting of foam material, having the exact form of the component to be obtained, is embedded in sand contained in a mould, and then the liquid metal is poured into the mould and takes the place of the foam which evaporates.

Lost patterns of internal-combustion engine cylinder blocks are obtained, at present, as a result of the assembly and adhesive bonding of different pattern parts produced separately. The disadvantage of assembling the various elements is that it gives rise to leaks and cracks, especially in the water box of the engine. This technique also makes it necessary to carry out a difficult assembly of the different parts of the pattern with great accuracy, and this can cause numerous faults in the connection zone of the various parts.

The object of the invention is to provide a mould making it possible to produce a cylinder-block pattern in one piece, especially from expanded polystyrene.

To achieve this, the invention provides a mould characterized in that it comprises three mould segments superposed in the direction of the axis of the cylinders, an upper segment making it possible to carry out the prior moulding of the upper part of the pattern comprising the cylinders and at least one portion of the voids, a lower segment making it possible to carry out the prior moulding of the lower part of the pattern comprising the bearings and at least one portion of the recesses, and a central segment making it possible to carry out the moulding of the central part of the pattern comprising the matching portions of the said portions of the voids and of the recesses between the said upper and lower parts.

As a result of this mould design, in which a central segment is interposed between two end segments in which the upper and lower parts of the pattern have previously been folded, it is possible to carry out the operation of moulding the central part of the pattern, whilst at the same time ensuring perfect continuity of the expanded polystyrene foam and thus obtain an integral cylinder-block pattern.

According to another characteristic of the invention, the mould has an upper removable mould element which interacts with the upper segment during the operation of the prior moulding of the upper part of the pattern, in order to delimit the portions of the voids and close the orifice of the moulding cavity of the upper segment which opens onto the lower face of the latter.

In a symmetrical way, it also possesses a lower removable mould element which interacts with the lower segment during the operation of the prior moulding of the lower part of the pattern, in order to delimit the portions of the recesses and close the orifice of the moulding cavity of the lower segment which opens onto the upper face of the latter. Finally, the lower and upper faces can be produced in the form of plane faces which are perpendicular to the axis of the cylinders, with which two parallel and opposite plane faces of the central segment of the mould interact.

The invention also provides a process for the moulding of a foundry pattern, putting into practice a mould according to the invention, characterized in that it involves the following steps:

(a1) The prior moulding of the upper part of the pattern by means of the upper segment of the mould equipped with the upper removable mould elements;

(a2) the prior moulding of the lower part of the pattern by means of the lower segment of the mould equipped with the lower removable mould element;

(b) the removal of the upper and lower removable mould elements;

(c) the production of the mould by interposing the central segment between the lower face of the upper segment and the upper face of the lower segment and assembling the three segments; and (d) the moulding of the central part of the pattern.

According to another characteristic of the process, the two steps of prior moulding can be carried out simultaneously.

Other characteristics and advantages of the invention will emerge from a reading of the following detailed description, for the understanding of which reference will be made to the accompanying drawings in which.

Figure 2:
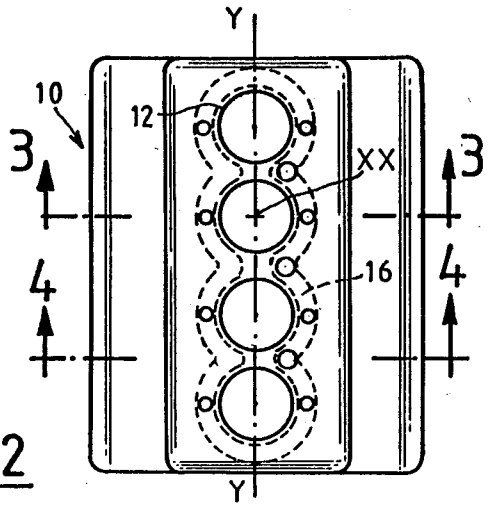
FIG. 2 is a plan view of the pattern of FIG. 1.
Figure 4:
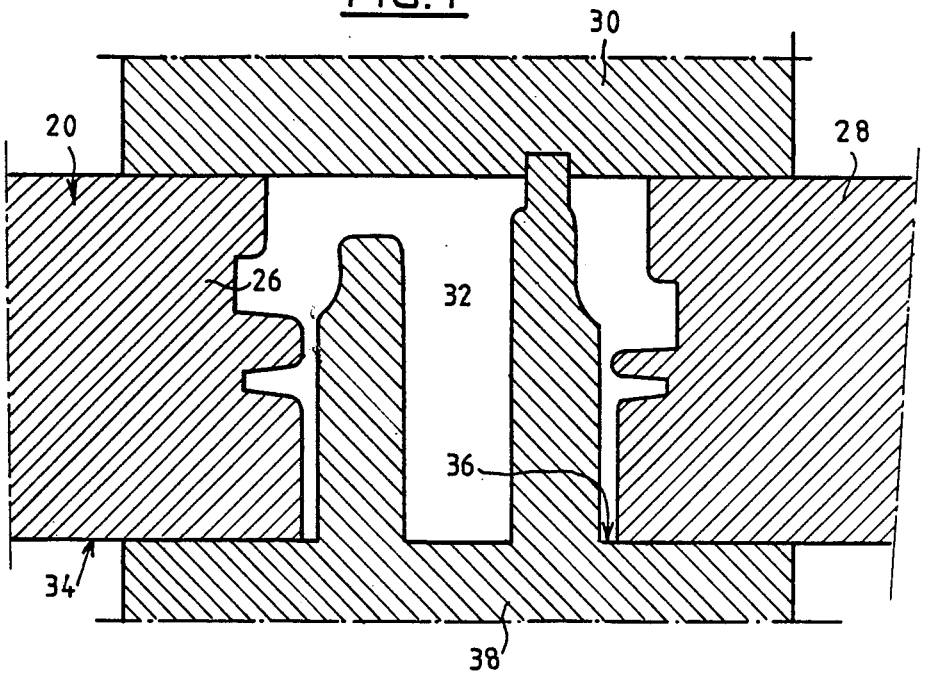
FIG. 4 is a view similar to that of FIG. 3, taken in a section along the line 4—4 of FIG. 2.
Figure 5:
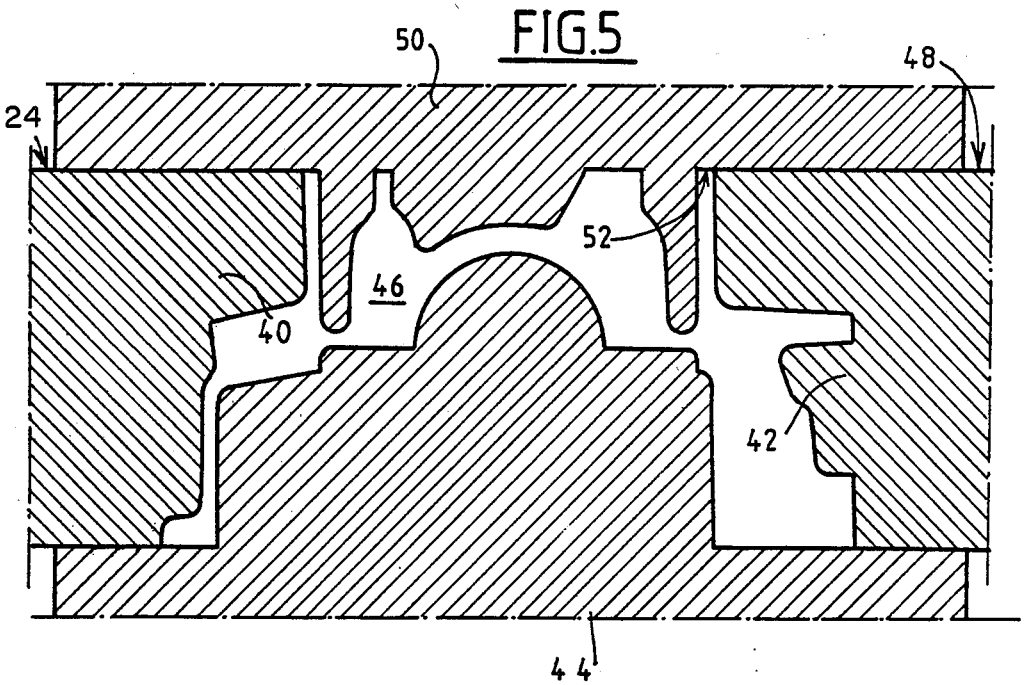
FIG. 5 is a view on an enlarged scale, in a section along the line 4—4 of FIG. 2, of the lower segment of the mould according to the invention, equipped with its lower removable mould element.
Figure 6:
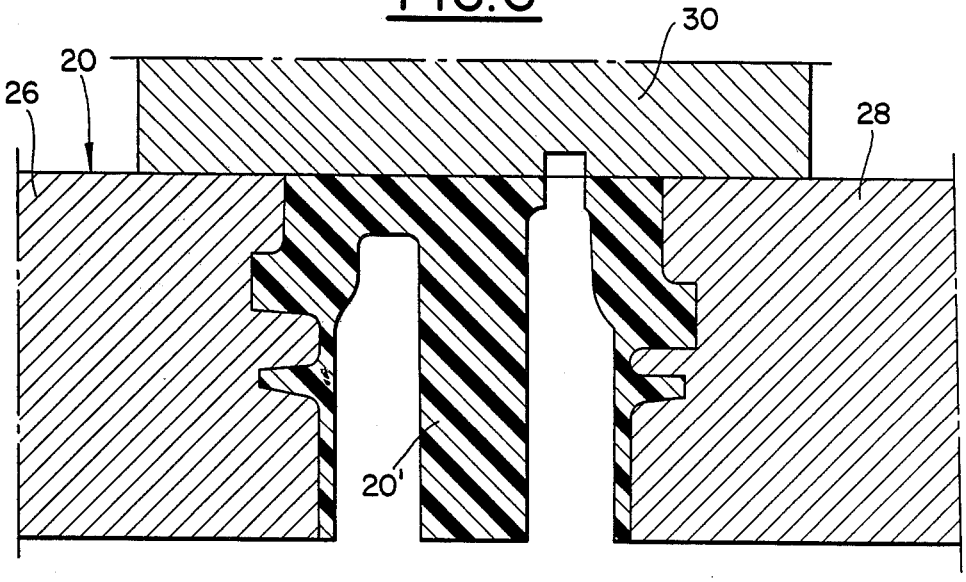
Figure 7:
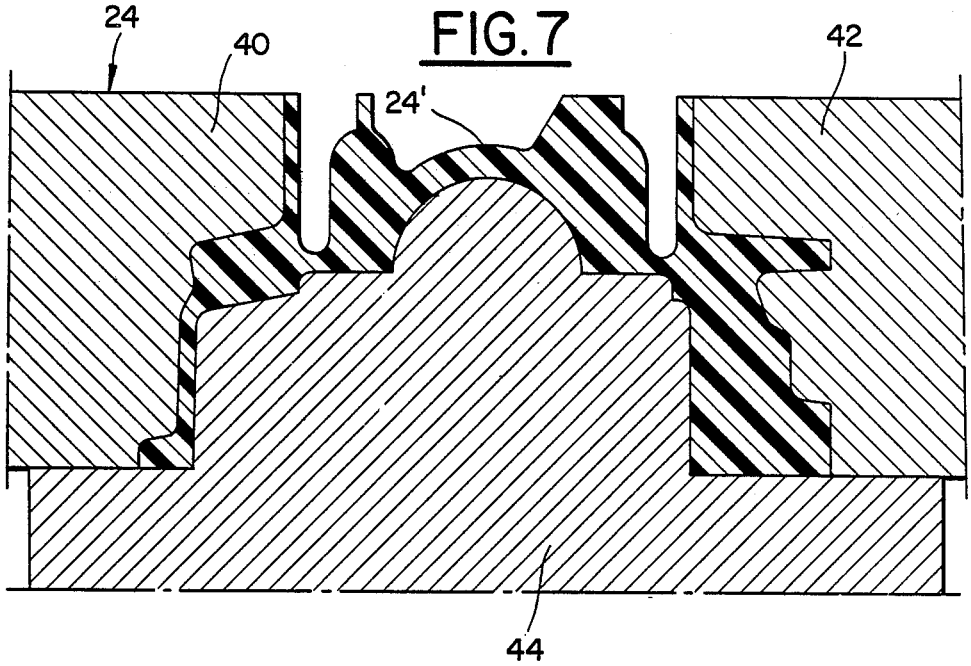
Figure 8:
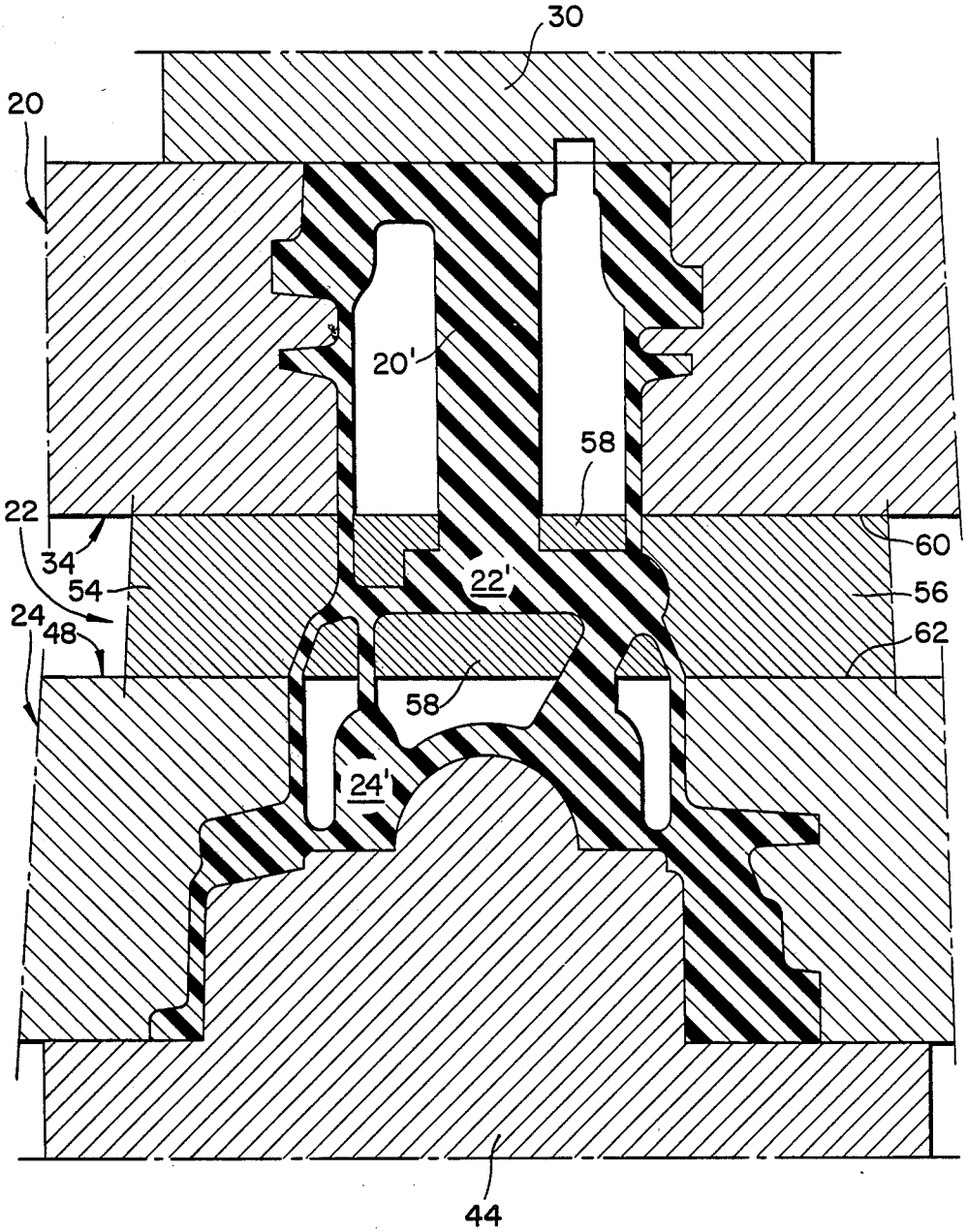

FIGS. 6 and 7 are views similar to those of FIGS. 4 and 5, after the operations of the prior mould ding of the upper and lower parts of the pattern have been carried out and after the removable mould elements have been removed; and FIG. 8 is a sectional view of the mould according to the invention along the line 4—4 of FIG. 2 in which the three mould segments are shown in their superposed and assembled position, and after the central part of the pattern has been moulded.

Figure 1:
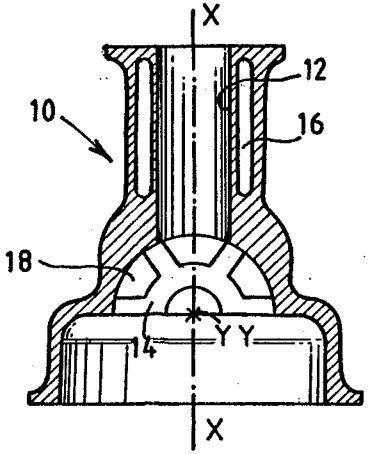
FIG. 1 is a simplified diagrammatic view, in a vertical section along the line 3—3 of FIG. 2, of a foundry pattern of an internal-combustion engine cylinder block.

The foundry pattern 10 made of expanded polystyrene and illustrated in FIG. 1 has the exact form of an internal-combustion engine cylinder block comprising several aligned cylinders 12 of parallel axes X—X and several bearings 14 for the mounting of a crankshaft (not shown), the axis Y—Y of which is perpendicular to the axis X—X of the cylinders 12. The cylinder block also has voids 16 formed round the cylinders 12 and recesses 18 between the bearings 14 and the cylinders 12.

As can be seen in FIG. 8, the mould according to the invention comprises three mould segments 20, 22 and 24 superposed in the direction of the axis X—X of the cylinders.

The upper segment 20 makes it possible to carry out the prior moulding of the upper part 20' of the pattern, in which the cylinders 12 and at least one portion of the voids 16 are formed. The upper segment 20 comprises lateral mould elements 26 and 28 and a stationary upper element 30 which delimit a cavity 32, in which the operation of the prior moulding of the upper parts 20' of the pattern is carried out. The cavity 32 opens onto the lower face 34 of the upper segment 20 via an orifice 36.

The cavity 32 and the corresponding portions of the voids 16 are likewise delimited, during the operation of the prior moulding of the upper part 20' of the pattern, by an upper removable mould element 38 which interacts with mould elements 26, 28 and 30 and which closes the orifice 36.

Figure 3:
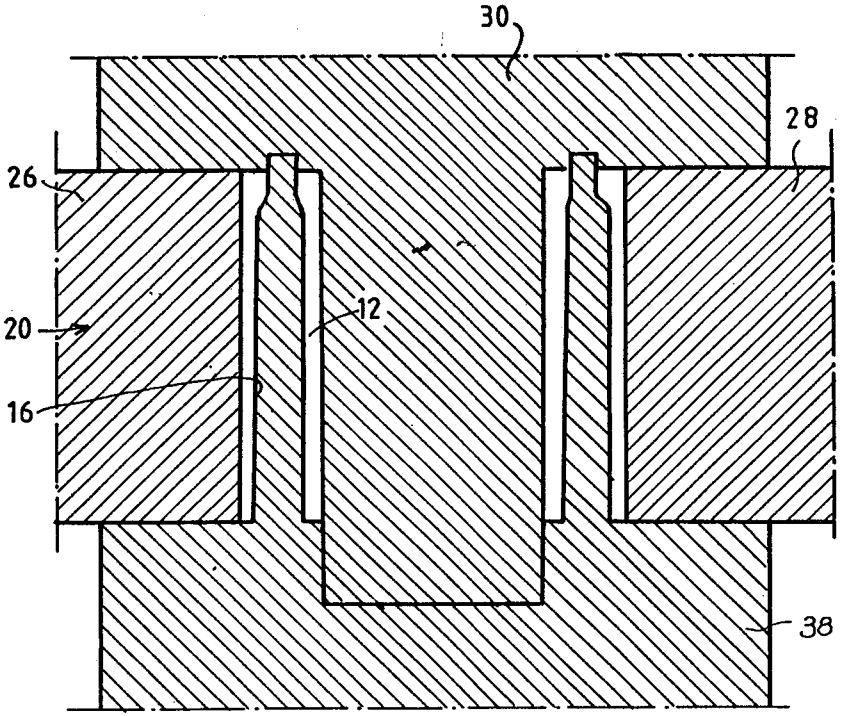
FIG. 3 is a view on an enlarged scale, in a section along the line 3—3 of FIG. 2, of the upper segment of a mould according to the invention, equipped with its upper removable mould element.

As illustrated in FIGS. 3 and 4, the upper segment 20 equipped with the upper removable mould element 38 constitutes an independent mould making it possible to produce the upper part 20' of the foundry pattern.

In the same way, the lower mould segment 24 consists of lateral mould elements 40 and 42 which interact with a stationary lower mould element 44, to make it possible to carry out the prior moulding of the lower part 24' of the pattern comprising the bearings 14 and at leeast one portion of the recesses 18 on the inside of a moulding cavity 46 which opens onto the upper face 48 of the lower segment 24.

As can be seen from FIG. 5, the lower segment 24 is equipped with a lower removable mould element 50 which, during the operation of the prior moulding of the lower part 24' of the pattern, interacts with the mould elements 40, 42 and 44 in order to delimit the moulding cavity 46 and the portions of the recesses 18 and close the orifice 52 of the cavity 46.

The lower segment 24, when equipped with the lower removable element 50, constitutes an independent mould, shown in FIG. 5, in which the operation of the prior moulding of the lower part 24' of the foundry pattern can be carried out.

The central segment 22 of the mould according to the invention likewise consists of lateral mould elements 54 and 56 which interact with removable mould elements 58 in order to delimit the moulding cavity of the central part 22' of the foundry pattern.

Assembly and fastening means not shown in Figure 8 make it possible to hold together the three superposed mould segments. The central segment 22 is delimited upwards and downwards by two parallel plane faces 60 and 62 respectively. These opposite plane faces 60 and 62 interact respectively with the lower face 34 of the upper segment 20 and the upper face 48 of the lower segment 24, the latter being plane faces perpendicular to the axis X—X of the cylinders.

As can be seen from FIG. 8, the three-segment mould according to the invention makes it possible to carry out the moulding of a foundry pattern in one piece according to a process which we will now describe.

After the various mould elements forming the upper segment 20 have been assembled, and after the latter has been equipped with the removable upper mould element 38 (FIGS. 3 and 4), the operation of the prior moulding of the upper part 20' of the foundry pattern is carried out.

In the same way, the various mould elements forming the lower segment 24 are assembled, and the latter is equipped with the lower removable mould element 50, and then the operation of the prior moulding of the lower part 24' of the foundry pattern is carried out.

According to a characteristic of the process, in order to accelerate the production rates for the foundry patterns, the two operations of the prior moulding of the upper and lower parts 20' and 24' of the foundry pattern can be carried out simultaneously.

After the two prior moulding operations have been carried out, the upper and lower removable mould elements 38 and 50 are removed. The upper and lower mould segments 20 and 24 then take the form illustrated in Figures 6 and 7.

Subsequently, the complete mould according to the invention is produced by interposing the central segment 22 between the lower face 34 of the upper segment 20 and the upper face 48 of the lower segment 24. When the three mould segments 20, 22 and 24 have previously been positioned and assembled in this way, all that remains is to carry out the operation of moulding the central part 22' of the pattern, so as to obtain an integral foundry pattern, as illustrated in FIG. 8, which requires no additional assembly operation.

Each of the segments 20, 22 and 24 of the mould consists in the conventional way of several pieces which, for example, can slide and fit together so that they can be removed after the final moulding operation.

I claim:

1. Mould for forming a foundry pattern, especially of expanded polystyrene, for an engine cylinder block having several aligned cylinders with parallel axes (X—X), several bearings for mounting a crankshaft, the axis (Y—Y) of the bearings being perpendicular to the axis of the cylinders, voids formed around the cylinders, and recesses between the bearings and the cylinders, the mould comprising three mould segments superposed in the direction of the axes of the cylinders, an upper segment for the prior moulding of an upper part of the pattern including the cylinders and at least one portion of the voids, a lower segment for the prior moulding of a lower part of the pattern including the bearings and at least one portion of the recesses, a central segment for moulding of a central part of the pattern to the upper and lower parts, the central segment including matching portions for the voids of the upper part and matching portions for the recesses of the lower part, means for aligning the upper and lower mould segments, and means for interposing the central segment between the upper and lower segments.

2. Mould according to claim 1, further including an upper removable mould element which interacts with a lower face of the upper segment during the operation of the prior moulding of the upper part of the pattern to delimit the said portions of the voids and close the moulding cavity of the upper segment which opens onto the lower face thereof.

3. Mould according to claim 2, further including a lower removable mould element which interacts with an upper face of the lower segment during the operation of the prior moulding of the lower part of the pattern to delimit the said portions of the recesses and close the moulding cavity of the lower segment which opens onto the upper face thereof, wherein the said lower and upper faces are plane faces which are perpendicular to the axis of the cylinders, and wherein the central segment has two opposite parallel plane faces which interact with the said upper and lower faces.

4. Mould according to claim 1, further including a lower removable mould element which interacts with an upper face of the lower segment during the operation of the prior moulding of the lower part of the pattern to delimit the said portions of the recesses and close the moulding cavity of the lower segment which opens onto the upper face thereof.

5. Process for the moulding of a foundry pattern comprising the following steps:

first moulding an upper part of the pattern by means of an upper segment of a mould equipped with a removable upper mould element;

moulding a lower part of the pattern by means of a lower segment of the mould equipped with a removable lower mould element;

removing the upper and lower removable mould elements;

producing the mould by interposing a central segment between a lower face of the upper segment and an upper face of the lower segment and assembling the three segments; and moulding the central part of the pattern.

6. Moulding process according to claim 5, wherein the first and second moulding steps are carried out simultaneously.

* * * * *